US005896686A

United States Patent [19]

Howes

[11] Patent Number: 5,896,686

[45] Date of Patent: Apr. 27, 1999

[54] MULTI-IMAGE PRIZE AWARD AND METHOD THEREFOR

[76] Inventor: James P. Howes, 122 St. Johns Rd., Wilton, Conn. 06897

[21] Appl. No.: 08/757,132

[22] Filed: Dec. 3, 1996

[51] Int. Cl.[6] ..... G09F 3/00

[52] U.S. Cl. ..... 40/311; 40/315; 40/454; 206/459.1; 206/459.5; 206/460; 215/230; 215/347; 215/349

[58] Field of Search ..... 40/313, 311, 315, 40/324, 332, 453, 454; 206/459.1, 459.5, 460; 215/228, 386, 230, 341, 347, 349, 203

[56] References Cited

U.S. PATENT DOCUMENTS

| | | | |
|---|---|---|---|
| 401,165 | 4/1889 | Heinemann | 40/453 |
| 1,878,541 | 9/1932 | Reinhold | 40/311 |
| 3,361,281 | 1/1968 | Kehe | 215/228 X |
| 4,033,059 | 7/1977 | Hutton et al. | 40/453 X |
| 4,444,329 | 4/1984 | Vollers | 40/311 X |
| 4,835,035 | 5/1989 | Bayer | 40/311 X |
| 5,098,302 | 3/1992 | Sekiguchi | 40/453 X |
| 5,100,330 | 3/1992 | Sekiguchi | 40/453 X |
| 5,161,979 | 11/1992 | Sekiguchi | 40/353 X |
| 5,364,274 | 11/1994 | Sekiguchi | 40/343 X |
| 5,494,445 | 2/1996 | Sekiguchi et al. | 40/453 X |
| 5,525,383 | 6/1996 | Witkowski | 40/324 X |
| 5,598,650 | 2/1997 | Brown | 40/453 |
| 5,695,346 | 12/1997 | Sekiguchi et al. | 40/453 X |

FOREIGN PATENT DOCUMENTS

| | | | |
|---|---|---|---|
| 176097 | 2/1922 | United Kingdom | 40/137 |

*Primary Examiner*—Donald P. Walsh
*Assistant Examiner*—Emmanuel M. Marcelo
*Attorney, Agent, or Firm*—Melvin I. Stoltz

[57] ABSTRACT

By employing an award determining prize member incorporating a lens constructed to cooperate with printed indicia which produces a minimum of two separate and distinct visual images, depending upon the angle at which images are viewed, a unique and highly valued prize member is created, as well as prize award members which are incapable of having prize related information observed by the consumer prior to purchasing the item. In the present invention, the visual image representing the prize award information is quickly and easily mounted to the inside surface of a cap and is constructed with at least one image thereof being visible only when viewed at an angle which is substantially perpendicular to the surface of the indicia. In this way, advance determination of winning prize members by consumers prior to opening and removing the cap from the container is eliminated.

12 Claims, 3 Drawing Sheets

MULTI-IMAGE PRIZE AWARD AND METHOD THEREFOR

TECHNICAL FIELD

This invention relates to promotional systems for providing consumer incentives to purchase products and, more particularly, to promotional systems for use with liquid products mounted in transparent containers.

BACKGROUND ART

In order to entice consumers to purchase a particular product, manufacturers have often employed a wide variety of promotional contests or games. One very popular contest or game promotion involves the printing of indicia under the sealing cap employed to close and sealingly retain a liquid product within a particular container. Typically, such products are liquid or moist products, such as soda, juices, beverages, soups, detergents, mayonnaise, salad dressings, and the like.

Although such promotional contests have become very popular and are widely used by a variety of manufacturers of different liquid or moist products, one major difficulty that has been encountered in the use and distribution of products employing a promotion of this nature is the ability of consumers to determine prize winning products from non-prize winning products prior to purchasing the product. By manipulating the closed product and carefully observing the printed material placed under the cap, winning products can be found on the store shelf and selected by the consumer. As a result, the desired random distribution of prizes to all purchasers is thwarted.

In typical constructions, a liquid, wet or moist product is contained in a transparent container having either a narrow or wide portal zone which is closed by a removable cap. When a prior art promotional contest is conducted, prize-related indicia is printed under the cap of every bottle, with some indicia representing a particular prize award, while other indicia represents a loss or a no prize statement. Although attempts have been made to prevent the consumer from easily determining the particular indicia printed under the cap prior to opening and removing the cap, some consumers have become adept at carefully manipulating the product into various orientations which enable the consumer to observe the indicia printed under the cap prior to removal of the cap from the container. As a result, such consumers are able to preselect a prize bearing product from non-prize bearing products, thereby eliminating the random nature of the distribution desired by the manufacturer.

Another problem typically encountered with prior art under-the-cap promotions is the similarity between such promotions and their inability to generate interest amongst consumers to switch from one particular product to the product for which the promotional contest is being run. Although substantial effort has been expended by manufacturers in attempting to develop promotional, under-the-cap type contests which are unique and capable of generating greater interest amongst consumers, the consuming public has generally viewed under-the-cap promotions as similar contests, regardless of the manner in which awards or prizes are being won. Consequently, limited interest is generated by such under-the-cap promotions and the substantial increase of sales desired by the manufacturer is often not realized.

Therefore, it is a principal object of the present invention to provide a promotional prize award member and distribution system which virtually eliminates any possibility that a prize bearing or awarding container can be pre-selected prior to opening the container.

Another object of the present invention is to provide a promotional prize award member and distribution system having the characteristic features described above which substantially increases consumer interest and distinguishes the promotional concept from all prior art promotional games.

Another object of the present invention is to provide a promotional prize award member and distribution system having the characteristic features described above which provides distribution of unique collectable items in a manner which is both inexpensive for the manufacturers to employ and exciting for consumers to receive and collect.

Other and more specific objects will in part be obvious and will in part appear hereinafter.

SUMMARY OF THE INVENTION

By employing the present invention, all of the difficulties and drawbacks found with prior art systems are virtually eliminated and a unique, promotional prize award member and distribution system is attained. In the present invention, the previously unattainable goals and objectives are realized by employing an award determining prize member which incorporates a lens constructed to cooperate with printed indicia which produces a minimum of two separate and distinct visual images, depending upon the angle at which the images are viewed. By employing this prize award member, a unique and highly valued prize member is created, as well as prize award members which are incapable of having prize related information observed by the consumer prior to purchasing the item.

Multi-image printed indicia in combination with lens members have been employed in various prior art consumer products. Most recently, computer generated printed indicia have enabled these products to attain greater visual excitement and interest, wherein a plurality of images are capable of being manipulated to produce a smooth, free-flowing, video representation. Typically, by employing an array of transparent rods, a plate lens, or a cluster of lenses, in combination with the precisely desired computer generated printed indicia, the angle of view of each of the images can be controlled, thereby creating either two cooperating images or a plurality of cooperating images each of which are presented precisely at the desired orientation or viewing angle. Prior art patents disclosing this technology include U.S. Pat. Nos. 5,098,302; 5,100,330; 5,161,979; 5,364,274; and 5,494,445.

As disclosed in these patents as well as in other similar patents, these prior art systems have typically been employed for generating consumer interest in products or advertising literature associated with the products. However, such prior art disclosures have never contemplated nor suggested the use of the prior art technology in the manner provided in the present application.

In accordance with the present invention, a multi-image prize award member is constructed for use in generating interest amongst consumers to buy a particular product. In this invention, each multi-image prize award member incorporates a lens member constructed for controlling the viewing angle of a desired multi-image display. The multi-image display is printed on the lens or an associated print member and incorporates at least two separate and independent images cooperatively associated with each other for viewing through the lens member. The resulting prize award member is employed as a promotional item mounted to the inside surface of a cap or closure for any desired product, typically a liquid or moist product distributed in a transparent container. In this way, a unique game promotion and prize award member is realized which is capable of eliminating all of the prior art problems associated with conventional under-the-cap promotions.

By creating a prize award member having two separate and independent visual images which are controllably viewable by the lens associated therewith, advance detection of a prize is realized. In the present invention, the visual image representing the prize award information is constructed for being visible only when viewed at an angle which is substantially perpendicular to the surface of the indicia. The second image, which represents a generic phrase or advertisement for the product being sold, is constructed for being visible when the game piece is viewed at an acute angle, such as any angle less than 85°.

By employing this construction, prize award members are achieved which are quickly and easily mounted to the inside surface of a cap and virtually eliminate any possibility that winning prize members can be predetermined by consumers before opening and removing the cap from the container. If a consumer were to attempt to the manipulate the bottle or container in a manner which would enable the prize award member to be visible to the consumer, without having the cap removed from the container, the viewing angle of the prize award member by the consumer would be at an acute angle, typically substantially less than 90°.

By constructing the prize award member in a manner which enables only the generic indicia or advertising information to be displayed at viewing angles less than 90°, any individual attempting to predetermine a winning prize member from a non-winning prize member is incapable of attaining such information, since the only visual display available to a consumer is the generic advertisement desired by the manufacturer. By employing the present invention, a consumer is able to view the prize related indicia only by removing the cap from the product and viewing the inside surface of the cap at a substantially perpendicular viewing angle. As a result, any possibility that consumers can select winning products from non-winning products prior to purchasing the product is completely eliminated.

In addition to providing a promotional contest capable of completely eliminating any possibility of pre-selection by consumers of only winning prize award containers, the present invention also provides a unique and valuable multi-image prize award member which is capable of being distributed in this simple, straightforward manner. In this regard, prize members are constructed with a plurality of images printed thereon, using the known technology, to provide a visual display which is desirable and visually pleasing to any consumer.

Such promotional prize award members represent valuable keepsakes or prizes in and of themselves, which can then be distributed to consumers by mounting the prize award member under the cap of the desired products. In this way, a unique promotional concept is realized which provides consumers with a valuable prize award in a convenient distribution system.

The invention accordingly comprises the several steps and the relation of one or more such steps with respect to each of the others and the apparatus embodying the features of construction, combination of elements, and arrangement of parts which are adapted to effect such steps, all as exemplified in the following detailed disclosure, and the scope of the invention will be indicated in the claims.

THE DRAWINGS

For a fuller understanding of the nature and objects of the invention, reference should be had to the following detailed description taken in connection with the accompanying drawings, in which.

DETAILED DESCRIPTION

By referring to FIGS. 1–9, along with the following detailed disclosure, the construction, operation, implementation and assembly of the multiimage prize award member of the present invention can best be understood. However, FIGS. 1–9 represent preferred alternate constructions for the present invention which are representative of various further alternate constructions in which the present invention can be employed. Consequently, it is to be understood that FIGS. 1–9, along with the following detailed disclosure, is to be considered illustrative of the present invention and not as a limitation thereof.

Figure 1:
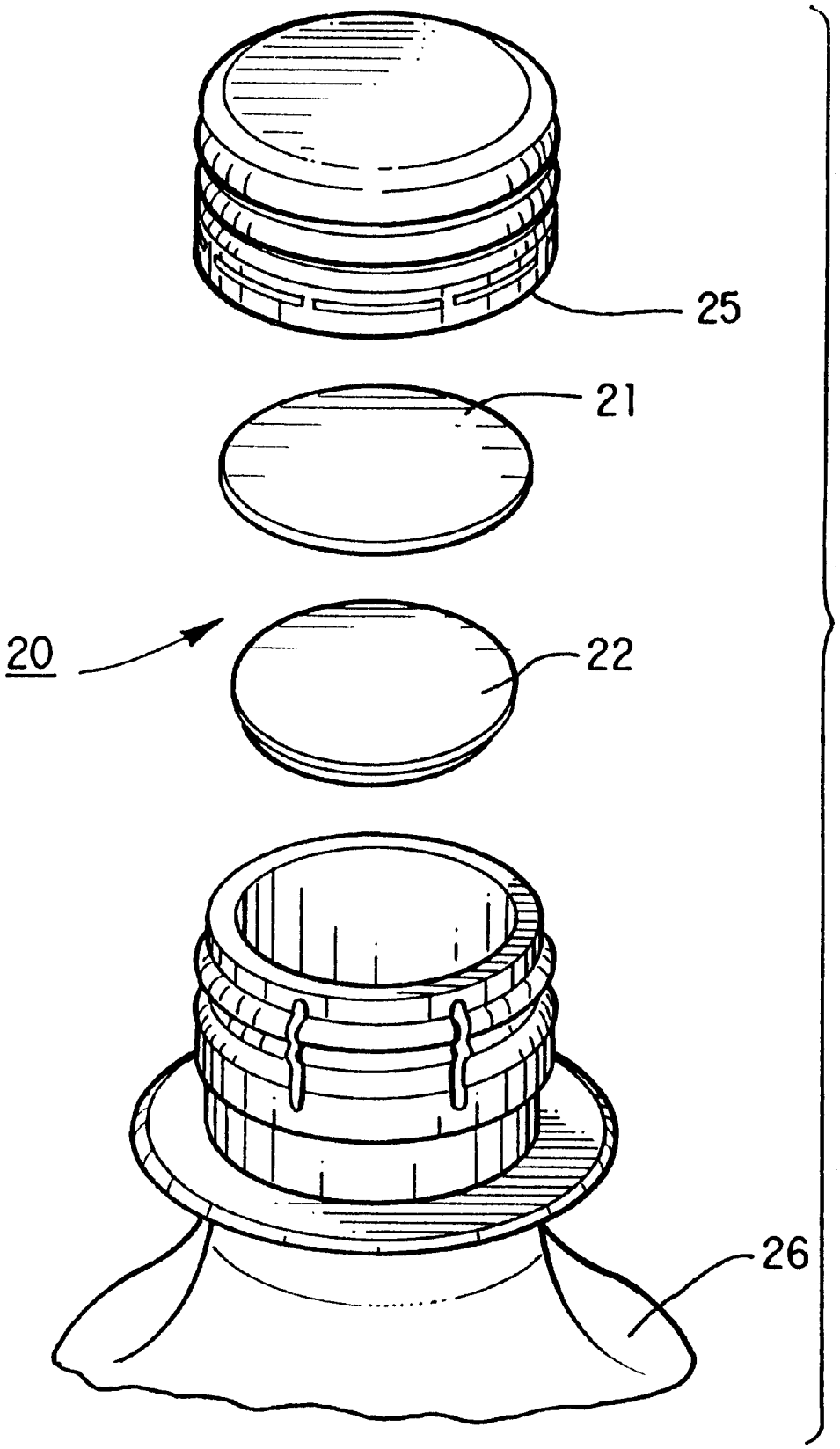
FIG. 1 is an exploded perspective view, partially broken away, depicting the prize award member of the present invention in association with a conventional bottle and removable cap.
Figure 2:
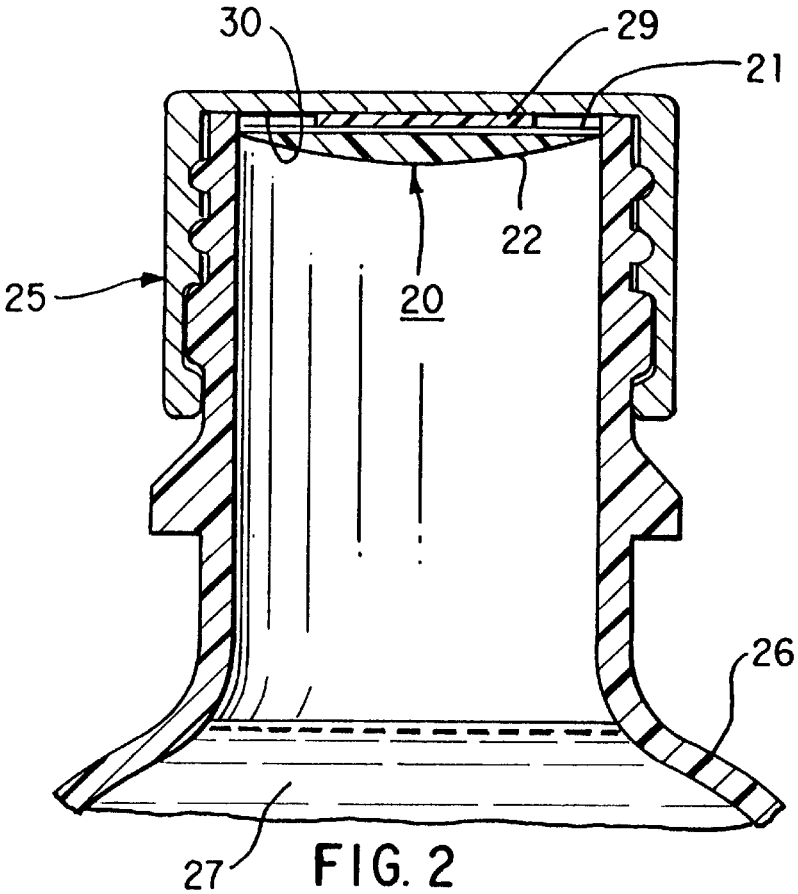
FIG. 2 is a cross-sectional, side elevation view, partially broken away, of the prize award member of the present invention mounted in position as depicted in FIG. 1.

As best seen in FIGS. 1 and 2, multi-image prize award member 20 comprises a print portion 21 and a lens portion 22. If desired, the particularly desired multi-image printed indicia can be placed directly upon lens portion 22, thereby eliminating print portion 21.

As depicted in FIGS. 1 and 2, in this embodiment, multi-image prize award member 20 is mounted in removable cap 25 of product holding container 26. For exemplary purposes only, product holding container 26 is depicted retaining a conventional beverage 27. However, any liquid, moist or wet product commonly distributed in containers of this nature may be the product employing the present invention.

Depending upon the construction desired, multi-image prize award member 20 may be constructed with a diameter to enable its secure retention within cap 25 by friction. In this embodiment, as generally depicted in FIG. 1, lens portion 22 of multi-image prize award member 20 comprises a diameter substantially equivalent to the inside diameter of removable cap 25. In this way, multi-image prize award member 20 can be easily positioned in secure frictional engagement with cap 25, assuring its secure retention therein.

When multi-image prize award member 20 is secured in position within cap 25, cap 25 is mounted to bottle 26 in order to secure and seal the desired product therein. In addition, when cap 25 is to be removed for access to product or beverage 27, retained in holding container 26, cap 25 is removed from container 26 with multi-image prize award member 20 securely retained in its original frictionally engaged position within cap 25.

In an alternate embodiment, as depicted in FIG. 2, adhesive means 29 is employed to securely retain multi-image prize award member 20 with removable cap 25. In the embodiment depicted in FIG. 2, adhesive means 29 comprises a strip of double-sided adhesive tape which is affixed on one surface to the back surface of print portion 21 of multi-image prize award member 20 with the opposed surface of tape means 29 being affixed to inside surface 30 of cap 25. In this way, multi-image prize award member 20 is securely affixed directly to inside surface 30 of removable cap 25 assuring the secure, trouble-free mounted interengagement of multi-image prize award member 20 with cap 25.

Although double-sided adhesive tape is preferred for adhesive means 29, any other desired adhesive member can be employed, in accordance with this invention, without departing from the scope thereof. In addition, as is evident from the foregoing detailed disclosure, the use of adhesive means 29 assures the secure retention of multi-image prize award member 20 in the precisely desired location in cap 25, while also enabling multi-image prize award member 20 to be removed from cap 25 whenever desired by the consumer, after cap 25 has been removed from container 26.

In one embodiment of the present invention, multi-image prize award member 20 comprises two separate and independent images each of which are visible only by viewing multi-image prize award member 20 at a particular viewing angle relative to lens portion 22. As is inherent in the construction of lenticular lens portion 22, as detailed above, a particular observation angle enables the viewer to see a specific image printed on print portion 21, while any other printed indicia contained on print portion 21 is incapable of being observed. Then, by changing the angle of view through lens portion 22, an alternate image printed on print portion 21 is seen, while the previous image is incapable of being seen.

In the preferred construction, lens portion 22 comprises a plurality of transparent rods, or cluster of crystalline or anamorphic lenses formed to provide a particular unique display that achieves the illusion of animation as the angle of site relative to the lens portion changes. By combining the use of lens portion 22 with a specially produced print portion 21, wherein superimposed multi images are placed thereon constructed for cooperative association with lens portion 22, this unique multi-image display member is achieved.

Figure 3:
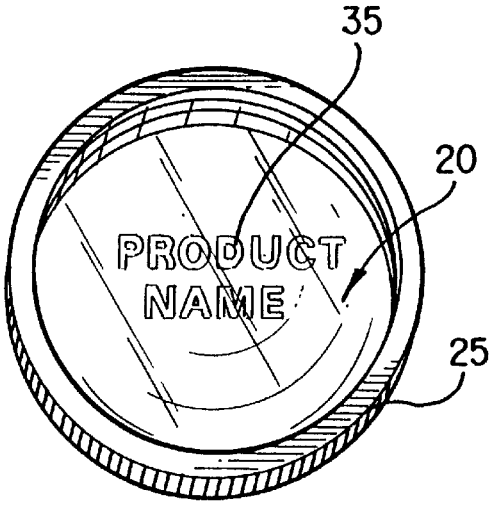
FIG. 3 is a bottom plan view depicting one image of the prize award member of the present invention.
Figure 4:
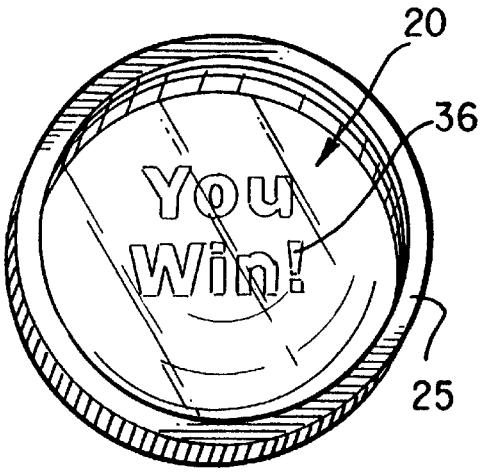
FIG. 4 is a bottom plan view depicting a second image of the prize award member of the present invention as mounted to the inside surface of a removable cap.

As detailed above and shown in FIGS. 3 and 4, multi-image prize award member 20 is secured within removable cap 25 so as to enable one of the two alternate images printed on print portion 21 to be displayed, depending upon the particular viewing angle at which multi-image prize award member 20 is observed. In this way, multi-image prize award member 20 can be employed in direct association with product containers whereby multi-image prize award member 20 can be distributed conveniently and easily to consumers, enhancing the enjoyment of the product by the consumer by attaining an additional prize award. In addition, as depicted in FIGS. 3–6 and detailed below, multi-image prize award member 20 can be employed for secretly and completely undiscoverably, randomly distributing prize award information to consumers of a particular product.

As is well known in the promotional industry, the printing of prize related indicia on inside surface 30 of cap 25 has been often employed. However, in such promotions, particular letters or prize related information is printed on selected caps and consumers receiving bottles having such particular information become award recipients.

Although the intent of the manufacturer and product distributor is to place the award information on inside surface 30 of cap 25 in a manner which prevents any consumer from obtaining knowledge of the award information prior to removal of the cap from bottle 26, many individuals have discovered that by holding bottle 26 in a particular orientation, while cap 25 remains sealed to container 26, the indicia printed on surface 30 of cap 25 can be observed. As a result, these consumers are able to determine in advance, prior to purchasing any product, which product should be selected in order to obtain a particular prize award. Consequently, the random distribution of prize awards is completely thwarted and individuals having this knowledge are capable of selecting the particular containers having the higher value prize information printed thereon.

Although attempts have been made to prevent individuals from being capable of determining in advance the information printed on surface 30 of cap 25, such prior art systems have been incapable of eliminating this problem. However, by employing the present invention, all of these prior art difficulties are eliminated and a unique multi-image prize award member and method of use is realized.

By referring to FIGS. 3–6, along with the following detailed discussion, the construction and operation of this embodiment of the present invention can best be understood as well as the ability of the present invention to overcome all of the prior art difficulties and drawbacks. As shown in FIGS. 3 and 4, multi-image prize award member 20 is mounted in the desired position, as detailed above, in cap 25. In this embodiment, multi-image prize award member 20 comprises two separate and distinct images, namely a product related image 35, depicted in FIG. 3, and a prize related image 36, depicted in FIG. 4. For exemplary purposes only, image 35 is depicted as a product name, while image 36 is depicted as prize winning information. As is evident to one of ordinary skill in the art, images 35 and 36 may contain any desired phraseology or information which a manufacturer would find most suitable.

Figure 5:
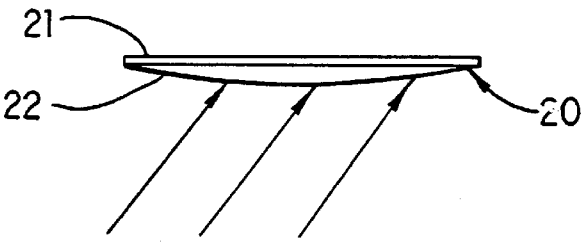
FIG. 5 is a diagrammatic view depicting the viewing angle for the image depicted in FIG. 3.
Figure 6:
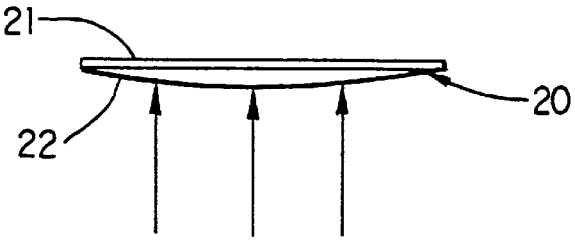
FIG. 6 is a schematic view depicting the prize award member of the present invention and the viewing angle for the image depicted in FIG. 4.

In order for a consumer to observe image 35 which is formed on print portion 21 of multi-image prize award member 20, the observer must view lens portion 22 at an acute angle, as depicted in FIG. 5. In order to observe image 36, as printed on print portion 21 of multi-image 20, the observer must rotate multi-image prize award member 20 to a substantially perpendicular orientation, as depicted in FIG. 6. When the observation angle of multiimage prize award member 20 is substantially perpendicular to multi-image prize award member 20 and cap 25, the observer is able to see image 36 as printed on print portion 21.

By employing the present invention, in the manner detailed above, no consumer is able to determine in advance whether the multi-image prize award member 20 mounted in a particular cap 25 of container 26 contains a prize award message 36 or an alternate "sorry" or "no prize" message. As is evident from the foregoing detailed disclosure, by employing multi-image prize award member 20 of this invention, any consumer attempting to observe the indicia contained on multi-image prize award member 20 prior to purchasing the particular product and removing cap 25 from container 26, is forced to observe multi-image prize award member 20 at only an acute angle. Consequently, although indicia printed on multi-image prize award member 20 may be observed by such an individual, the only image visible to such is a consumer is image 35, which represents a product related message or a product name or logo.

Regardless of which way container 26 is turned, twisted, or manipulated, no consumer is capable of observing multi-image prize award member 20 at an angular orientation which will reveal prize related image 36. Only after the product has been purchased by a consumer and cap 25 has been removed from container 26 is that consumer able to view both image 35 and image 36 by arcuately moving cap 25 with multi-image prize award member 20 mounted therein. In addition, only by observing multi-image prize award member 20 at an angle substantially perpendicular thereto, is the consumer capable of seeing image 36, revealing whether or not that consumer has won a particular prize.

As is evident from the foregoing detailed disclosure, the present invention completely eliminates all of the prior art difficulties and drawbacks and attains a multi-image prize award member capable of preventing advance detection of a prize award without actually purchasing the product, as desired by the manufacturers and distributors. By employing the present invention, any pre-opening prize determination is completely eliminated, thereby increasing product purchases as well as attaining the desired random distribution of prizes to all purchasing customers. Furthermore, a unique, valuable prize awarding member is also attained, thereby further enhancing the consumer's interest and excitement in the promotional concept.

Figure 7:
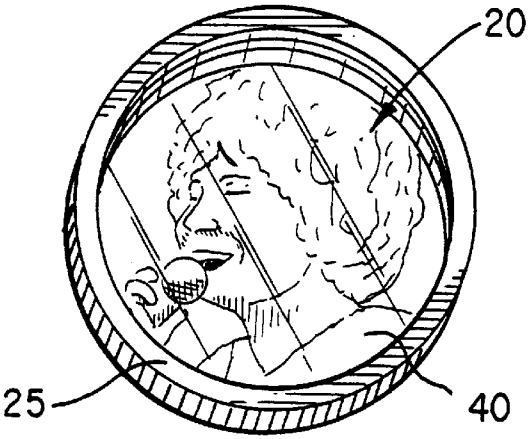
FIGS. 7–9 are top plan views of alternate embodiments of the prize award member of the present invention depicting alternate images associated therewith and visual therethrough.
Figure 8:
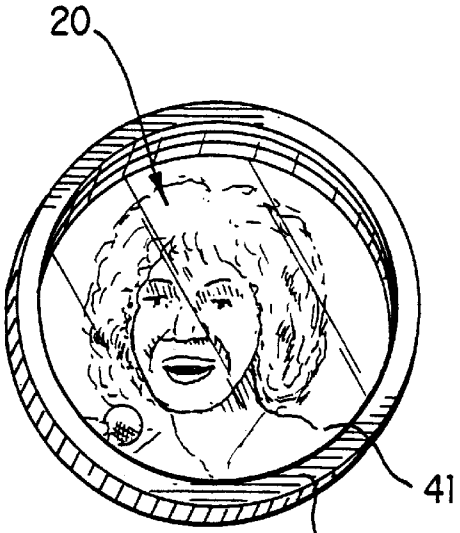
Figure 9:
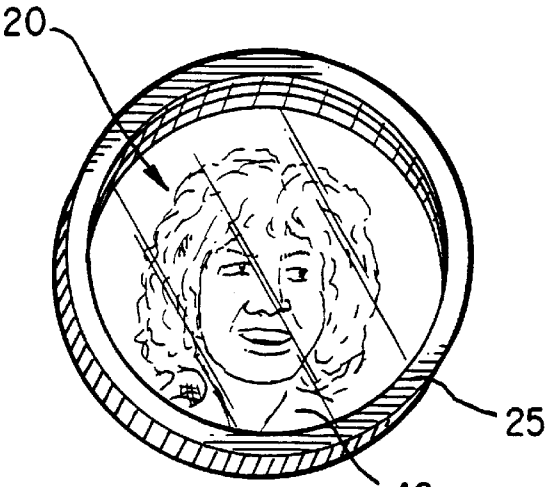

In FIGS. 7, 8, and 9, a further embodiment of the present invention is depicted. In this embodiment, multi-image prize award member 20 is constructed with three or more separate and distinct images printed on print portion 21, each of which are separately and independently viewable through lens portion 22, depending upon the angle at which multi-image prize award member 20 is positioned relative to the observer. For exemplary purposes only, this embodiment of multi-image prize award member 20 is depicted with three separate and distinct images, image 40 of FIG. 7, image 41 of FIG. 8, and image 42 of FIG. 9. However, as will be apparent to one of ordinary skill in the art, numerous additional images can be placed on print portion 21 for cooperative association with lens portion 22 in order to provide an increased animated visual display, with a plurality of images providing a display which visually produces smooth, continuous movement of a person or object in a single display.

In this embodiment, multi-image prize award member 20 may comprise any desired diameter which is conveniently mounted in a removable cap or closure means associated with any desired product. In particular, since many products are now distributed in containers having enlarged portal zones, caps or closures for these products can incorporate the present invention, thereby providing substantially enhanced, exciting and interest generating award member for association therewith.

In this embodiment, the multi-image prize award member 20 affixed to the cap or closure of the desired product represents the prize award, with a plurality of different subjects being represented in the multi-image display contained therein. In the embodiment depicted in FIGS. 7–9, a well-known vocalist is depicted in image 40 of FIG. 7 in a first position, facing toward the vocalist's right-hand side. In this embodiment, multi-image prize award member 20 depicts the vocalist in the process of turning her head from her right side to her left side. In image 41 of FIG. 8, the vocalist is shown facing forward, while image 42 of FIG. 9 shows the vocalist facing towards her left-hand side.

By continuously articulating or arcuately moving this embodiment of multi-image prize award member 20, continuous, free flowing motion of the vocalist in the process of turning is realized. Furthermore, as detailed above, by incorporating a plurality of additional images, each of which represent alternate positions during the turning process, a smoother, continuous, animated visual display is realized, thereby providing further enhanced interest and visual excitement to the consumer.

By employing this embodiment of multi-image prize award member 20, a unique prize awarding system is realized which provides consumers with high value, interest-generating display members capable of providing consumers with a product to be collected and retained. Furthermore, by distributing this high value prize award to consumers as an in-product surprise award, further enhanced benefits of purchasing a particular product are provided.

It will thus be seen that the objects set forth above, among those made apparent from the preceding description, are efficiently attained and, since certain changes may be made in carrying out the above method and in the constructions set forth without departing from the scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language might be said to fall therebetween.

Having described my invention, what I claim as new and desire to secure by Letters Patent is:

1. A method for providing a product promotion wherein prize awarding information is directly associated with a product retained in a container having a removable cap and the prize information is hidden prior to opening the product in a manner which enables the product bearing the prize awarding information to be undiscoverably, randomly distributed with products having no prize awarding information, comprising the step of:

A. preparing a prize award member comprising:
   a. at least two separate and distinct viewable images formed on one image bearing surface, one of said images representing prize awarding information, and
   b. a lens member cooperatively associated with the images and incorporating image viewing control means whereby each of said images is viewable only at a specific angle relative to said lens member;

B. mounting said prize award member to said removable cap associated with the container for the desired product;

C. affixing the cap and prize award member to the product container in a manner which prevents the image representing the prize awarding information to be viewable prior to removal of the cap from the container regardless of manipulation of the container prior to opening; and whereby a valuable prize award member is attained for distribution with any desired product providing a greatly enhanced, exciting and interest generating promotional system, wherein at least one image is incapable of being viewed prior to the removal of the cap from the container and the container is capable of being secretly, randomly distributed with containers having no prize awarding information and remaining undiscoverable prior to opening.

2. The method defined in claim 1, wherein said prize award member is further defined as comprising two separate and distinct images and said lens member is further defined as enabling the prize related image to be visible only when said prize award member is viewed substantially perpendicularly, whereby observation of the prize related visual image is incapable of being observed while said cap is affixed to said container.

3. The method defined in claim 2, wherein said second image comprises a product related message which is visible through said lens member at acute observation angles, whereby any attempt to observe the message contained on said prize award member while said cap remains on a container reveals only the product related image.

4. The method defined in claim 1, comprising the additional steps of selecting a desired product for the promotion, said product employing a transparent container for housing a liquid, wet, or moist product with said product being sealingly retained in said container by a removable cap.

5. The method defined in claim 1, wherein said prize award member is further defined as comprising at least three separate and distinct images, each of which are separately viewable as said prize award member is arcuately pivoted relative to a fixed position, with said prize award member representing the prize distributed to the consumer in said product.

6. A container assembly for use in association with liquid, semi-liquid, and moist products, said container assembly comprising:

A. a housing
- a. identical in appearance to product bearing housings employed for the liquid, semi-liquid or moist products,
- b. defining an internal retaining zone; and
- c. comprising at least one entry portal formed at one end thereof;

B. closure means cooperatively associated with the housing for closing the entry portal thereof;

C. means positioned in the retaining zone for providing the container assembly with the sound, weight, and feel of the product normally contained therein; and D. a multi-image prize awarding member securely positioned on the closure means and is within the retaining zone of the housing when the closure means is affixed to the housing, said prize awarding member comprising
- a. at least two separate and distinct viewable images formed on one surface of said multi-image prize awarding member, and
- b. a lens member
  - 1. cooperatively associated with the images and fixedly mounted in overlying engagement therewith
  - 2. incorporating image viewing control means for enabling each of said images to be viewable only at a specific angle relative to said lens member, and
  - 3. providing each of said images with a separate and distinct angle at which said image is viewable:

whereby the unique multi-image prize awarding member is distributable in direct association with any desired liquid, semi-liquid or moist products.

7. The container assembly defined in claim 6, wherein said means positioned in the retaining zone is further defined as comprising the actual liquid, semi-liquid or moist product being sold.

8. The container assembly defined in claim 6, wherein said prize award member comprises:

a. said two separate and distinct images with one of said images containing prize-related information; and b. said lens member is in overlying cooperative association with the images and comprising image viewing control means associated with said images to enable each of said images to be visible only when viewed at particular angles relative thereto.

9. The container assembly defined in claim 8, wherein said multi-image prize award member is further defined as comprising said two separate and distinct images cooperatively associated with said lens means with the prize related image being visible when said multi-image prize award member is viewed substantially perpendicularly, while said second, non-prize related image is visible when the multi-image prize award member is viewed at an acute angle thereto, whereby a prize award system is attained which prevents any individual from determining prize related information prior to actual removal of the closure means from the portal.

10. A prize award identifying container assembly for use in association with liquid, semi-liquid, and moist products, and constructed for being randomly distributed with non-prize awarding container assemblies, said container assembly comprising:

A. a housing
- a. identical in appearance to the product bearing housing employed for the liquid, semi-liquid or moist products,
- b. defining an internal retaining zone; and
- c. comprising at least one entry portal formed at one end thereof;

B. closure means
- a. cooperatively associated with the housing for closing the entry portal thereof, and C. means positioned in the retaining zone for providing the container assembly with the sound, weight, and feel of the product normally contained therein; and D. a multi-image prize awarding, information-bearing member positioned on the closure means and is within the retaining zone of the housing when the closure means is affixed to the housing, said prize awarding, information-bearing member comprising:
- a. at least two separate and distinct viewable images formed on one surface of said multi-image prize awarding member, one of said images representing prize awarding information, and
- b. a lens member
  - 1. cooperatively associated with the images and fixedly mounted in overlying engagement therewith,
  - 2. incorporating image viewing control means for enabling each of said images to be viewable only at a specific angle relative to said lens member, and
  - 3. providing each of said images with a separate and distinct angle at which said image is viewable, and
- c. said prize awarding, information-bearing image member remaining undiscoverable until the closure means is removed from the entry portal for gaining access to the internal retaining zone regardless of housing manipulation in attempting to view the prize awarding information bearing image;

whereby a unique dual-image prize awarding member is distributable in direct association with any desired liquid, semi-liquid or moist products with the prize-related image associated therewith being undiscoverable prior to removal of the closure means from the portal.

11. The prize award identifying container assembly defined in claim 10, wherein said housing incorporates a cylindrically shaped, threaded zone adjacent the entry portal, the closure means comprises a cap having an entry portal engaging base surrounded by a thread bearing cylindrically shaped wall portion constructed for mating threaded engagement with the threaded zone of the housing, and the multi-image prize awarding member is mounted on the inside surface of the base of the cap.

12. The prize award identifying container assembly defined in claim 11, wherein said lens member is constructed to enable the prize awarding information image to be visible at the smallest arcuate angle, and said wall portion of the cap is further defined as extending from the base thereof a sufficient distance to obscure the visibility of the prize awarding information image when the cap is mounted to the housing.

* * * * *